US012691986B2

(12) United States Patent
Tagata

(10) Patent No.: US 12,691,986 B2
(45) Date of Patent: Jul. 28, 2026

(54) MARINE PROPULSION SYSTEM AND MARINE VESSEL

(71) Applicant: YAMAHA HATSUDOKI KABUSHIKI KAISHA, Iwata (JP)

(72) Inventor: Akihiro Tagata, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 155 days.

(21) Appl. No.: 18/651,732

(22) Filed: May 1, 2024

(65) Prior Publication Data

US 2024/0383596 A1 Nov. 21, 2024

(30) Foreign Application Priority Data

May 16, 2023 (JP) ..... 2023-080902

(51) Int. Cl.
*B63H 21/21* (2006.01)
*B63B 79/40* (2020.01)

(52) U.S. Cl.
CPC ..... *B63H 21/213* (2013.01); *B63B 79/40* (2020.01); *B63H 2021/216* (2013.01)

(58) Field of Classification Search
None
See application file for complete search history.

(56) References Cited

U.S. PATENT DOCUMENTS 9,248,898 B1 * 2/2016 Kirchhoff ..... B63H 25/42
2005/0266743 A1 12/2005 Okuyama
2009/0009364 A1 * 1/2009 St-Pierre ..... B63B 34/63 340/984
2009/0247026 A1 10/2009 Suzuki et al.
2011/0036327 A1 2/2011 Shimamura et al.
2012/0124979 A1 * 5/2012 Noma ..... F02D 41/0205 60/311
2012/0295501 A1 * 11/2012 Guglielmo ..... B63H 21/213 440/84

(Continued)

FOREIGN PATENT DOCUMENTS

JP 2005-335449 A 12/2005
JP 2009-241754 A 10/2009
JP 5190037 B2 4/2013

OTHER PUBLICATIONS

Official Communication issued in corresponding European Patent Application No. 24174059.6, mailed on Nov. 11, 2024, 12 pages.

*Primary Examiner* — Amelia Vorce
(74) *Attorney, Agent, or Firm* — Keating & Bennett, LLP

(57) ABSTRACT

A marine propulsion system includes a propulsion device to be provided on a hull, and a propulsion device operator including a vessel speed indicator to adjust a thrust of the propulsion device by changing an indicated vessel speed that is a vessel speed provided to the propulsion device, and a deceleration switch to receive an operation to enter a deceleration mode in which the vessel speed is decreased by a predetermined speed from the indicated vessel speed. The marine propulsion system is operable to enter the deceleration mode and decrease the vessel speed by the predetermined speed from the indicated vessel speed when the deceleration switch is turned on, and return the vessel speed to the indicated vessel speed before the deceleration mode was entered when an operation is performed to cancel the deceleration mode.

19 Claims, 3 Drawing Sheets

(56) References Cited

U.S. PATENT DOCUMENTS

| | | | | |
|---|---|---|---|---|
| 2017/0038771 | A1* | 2/2017 | Green | G05D 1/223 |
| 2021/0394877 | A1 | 12/2021 | Kadota et al. | |
| 2022/0081096 | A1* | 3/2022 | Nanjo | B63H 21/17 |
| 2022/0274679 | A1 | 9/2022 | Ikegaya | |
| 2022/0291682 | A1* | 9/2022 | Johnson | B63B 79/10 |
| 2023/0030345 | A1* | 2/2023 | Kato | B63H 21/213 |
| 2023/0242233 | A1* | 8/2023 | Vachon | B63B 34/10 440/1 |

* cited by examiner

MARINE PROPULSION SYSTEM AND MARINE VESSEL

CROSS REFERENCE TO RELATED APPLICATIONS

This application claims the benefit of priority to Japanese Patent Application No. 2023-080902 filed on May 16, 2023. The entire contents of this application are hereby incorporated herein by reference.

BACKGROUND OF THE INVENTION

1. Field of the Invention

The present invention relates to marine propulsion systems and marine vessels that each control a propulsion speed.

2. Description of the Related Art

A marine propulsion system including a deceleration switch is known in general. Such a marine propulsion system is disclosed in Japanese Patent Laid-Open No. 2009-241754, for example.

Japanese Patent Laid-Open No. 2009-241754 discloses a marine vessel including a control lever that includes a lever to allow a vessel user to adjust a vessel speed by tilting the lever and a deceleration switch on the control lever (remote control lever). The marine vessel decelerates by shifting from forward movement to reverse movement or from reverse movement to forward movement when the deceleration switch is pressed. The deceleration switch is also used in a fixed point holding mode in which the position of the marine vessel is maintained, for example.

Although not clearly described in Japanese Patent Laid-Open No. 2009-241754, when the marine vessel navigates in waves and rides over waves, an operation may be performed to temporarily decelerate the marine vessel so as to stabilize a hull. When the marine vessel attempts to ride over the wave without decelerating, the hull may become unstable by running on the wave and landing on the water. When the deceleration switch of the marine vessel described in Japanese Patent Laid-Open No. 2009-241754 is used to decelerate the marine vessel, shifting involves reversing the direction of a thrust, and thus the marine vessel is not stabilized. Furthermore, although not clearly described in Japanese Patent Laid-Open No. 2009-241754, the lever of the control lever (remote control lever) may be frequently operated for each wave so as to stabilize the hull, but such a lever operation needs to be reliably performed such that the lever position (the amount of deceleration by the lever and the amount of return operation after deceleration) is the same for each wave, and thus high vessel maneuvering skills are required. Therefore, it has been desired to stabilize the hull by easily decelerating the marine vessel when the marine vessel rides over a wave.

SUMMARY OF THE INVENTION

Example embodiments of the present invention provide marine propulsion systems and marine vessels that each allow hulls to be stabilized by easily decelerating the marine vessels when the marine vessels ride over a wave.

A marine propulsion system according to an example embodiment of the present invention includes a propulsion device to be provided on a hull, and a propulsion device operator including a vessel speed indicator to adjust a thrust of the propulsion device by changing an indicated vessel speed that is a vessel speed provided to the propulsion device, and a deceleration switch to receive an operation to enter a deceleration mode in which the vessel speed is decreased by a predetermined speed from the indicated vessel speed. The marine propulsion system is operable to enter the deceleration mode and decrease the vessel speed by the predetermined speed from the indicated vessel speed when the deceleration switch is turned on, and return the vessel speed to the indicated vessel speed before the deceleration mode was entered when an operation is performed to cancel the deceleration mode.

A marine propulsion system according to an example embodiment of the present invention includes the deceleration switch to receive an operation to enter the deceleration mode in which the vessel speed is decreased by the predetermined speed, and is operable to enter the deceleration mode and decrease the vessel speed by the predetermined speed when the deceleration switch is turned on. Accordingly, the deceleration switch is easily operated such that the deceleration mode is entered and the vessel speed is decreased by the predetermined speed. Therefore, delicate operations such as conventional lever operations are no longer required to enter the deceleration mode, and thus a marine vessel is easily decelerated to stabilize the hull when the marine vessel rides over a wave. Furthermore, the vessel speed is decreased by the predetermined speed from the indicated vessel speed indicated by the vessel speed indicator when the deceleration mode is entered, and the vessel speed returns to the indicated vessel speed before the deceleration mode was entered when the deceleration mode is canceled such that the indicated vessel speed indicated by the vessel speed indicator is maintained when the marine vessel rides over a wave.

In a marine propulsion system according to an example embodiment of the present invention, the deceleration switch preferably includes a single switch to alternately receive an on operation to enter the deceleration mode and an off operation to cancel the deceleration mode. Accordingly, unlike a case in which the deceleration switch includes a plurality of switches such as a case in which the deceleration switch includes a switch for deceleration and a switch for cancellation of deceleration, the number of components is reduced, and the complexity of the device structure is reduced or prevented. Furthermore, a vessel user does not need to move his/her fingers to operate a plurality of switches when performing an operation to enter the deceleration mode and an operation to cancel the deceleration mode, and thus the deceleration switch is easily operated. Therefore, the marine vessel is more easily decelerated to stabilize the hull when the marine vessel rides over a wave.

In such a case, the deceleration switch preferably includes a deceleration mode lamp that is on during the deceleration mode and is off when the deceleration mode is canceled. Accordingly, the vessel user easily visually understands whether or not the marine vessel is in the deceleration mode.

In a marine propulsion system according to an example embodiment of the present invention, the deceleration switch is preferably to be turned on before the hull rides over a wave. Accordingly, the marine vessel is decelerated in advance before the hull rides over a wave, and thus the possibility that the hull jumps from the wave, for example, when the hull rides over the wave is reduced or prevented.

In a marine propulsion system according to an example embodiment of the present invention, the propulsion device operator preferably further includes a speed control switch to receive an operation to enter a speed control mode in which the vessel speed is finely adjusted, and an operation to finely adjust the vessel speed in the speed control mode, and a fluctuation range corresponding to the predetermined speed by which the vessel speed is decreased from the indicated vessel speed when the deceleration switch is turned on and the deceleration mode is entered is preferably larger than an adjustment range of the vessel speed in the speed control mode in which the speed control switch is operated. Accordingly, as compared with adjusting the vessel speed in the speed control mode, the vessel speed is changed relatively largely when the marine vessel rides over a wave, and the hull is effectively stabilized.

In a marine propulsion system according to an example embodiment of the present invention, the marine propulsion system is preferably operable to decrease the vessel speed by the predetermined speed from the indicated vessel speed concurrently with entering the deceleration mode when the deceleration switch is turned on. Accordingly, the deceleration switch is operated only once such that the deceleration mode is entered, and the vessel speed is decreased by the predetermined speed from the indicated vessel speed. Therefore, the marine vessel is quickly decelerated to stabilize the hull when the marine vessel rides over a wave.

In a marine propulsion system according to an example embodiment of the present invention, the vessel speed indicator preferably includes a remote control lever including a lever to adjust the indicated vessel speed when a position of the lever is changed, and the deceleration switch is preferably provided on the remote control lever. Accordingly, the deceleration switch is provided on the remote control lever that is held by the vessel user when the vessel user maneuvers the marine vessel, and thus the deceleration switch is easily operated by the hand operating the remote control lever.

In such a case, the remote control lever preferably includes a fine adjustment switch to receive an operation to finely adjust the vessel speed in the deceleration mode by increasing or decreasing the vessel speed by a fluctuation range smaller than a fluctuation range corresponding to the predetermined speed by which the vessel speed is decreased from the indicated vessel speed when the deceleration mode is entered. Accordingly, when the marine vessel is decelerated in the deceleration mode, the fine adjustment switch is used to finely adjust the vessel speed such that the hull is further stabilized.

In a marine propulsion system including the remote control lever including the fine adjustment switch, the deceleration switch and the fine adjustment switch are preferably located side by side on the lever. Accordingly, as compared with a case in which the deceleration switch and the fine adjustment switch are spaced far apart from each other, the deceleration switch and the fine adjustment switch are easily operated.

In a marine propulsion system including the remote control lever including the fine adjustment switch, the propulsion device operator preferably further includes a speed control switch to receive an operation to enter a speed control mode in which the vessel speed is finely adjusted, and an operation to finely adjust the vessel speed in the speed control mode, the fine adjustment switch is preferably also used as the speed control switch, and the marine propulsion system is preferably operable to finely adjust the vessel speed by increasing or decreasing the vessel speed in response to an operation on the fine adjustment switch in the deceleration mode without entering the speed control mode. Accordingly, as compared with a case in which the fine adjustment switch and the speed control switch are separate, the number of switches in the propulsion device operator is reduced, and the device structure is simplified.

In a marine propulsion system including the deceleration switch on the remote control lever including the lever the deceleration mode may be canceled by changing the position of the lever of the remote control lever. Accordingly, the deceleration mode is canceled by various methods, and thus the operability of the marine propulsion system is improved.

In a marine propulsion system according to an example embodiment of the present invention, a fluctuation range corresponding to the predetermined speed by which the vessel speed is decreased from the indicated vessel speed when the deceleration switch is turned on and the deceleration mode is entered is preferably variable, and the propulsion device operator is preferably operable to receive an operation to vary the fluctuation range. Accordingly, the magnitude of the predetermined speed by which the vessel speed is decreased from the indicated vessel speed when the deceleration switch is turned on and the deceleration mode is entered is adjusted taking into consideration wave conditions such as a wave size and a wave speed.

In a marine propulsion system according to an example embodiment of the present invention, the deceleration switch is preferably a mechanical button operable by being pressed. Accordingly, the deceleration switch, which is a mechanical button (physical button) operable by being pressed, is operated such that the marine vessel is easily decelerated to stabilize the hull when the marine vessel rides over a wave.

A marine vessel according to an example embodiment of the present invention includes a hull, and a marine propulsion system provided on or in the hull. The marine propulsion system includes a propulsion device, and a propulsion device operator including a vessel speed indicator to adjust a thrust of the propulsion device by changing an indicated vessel speed that is a vessel speed provided to the propulsion device, and a deceleration switch to receive an operation to enter a deceleration mode in which the vessel speed is decreased by a predetermined speed from the indicated vessel speed, and the marine propulsion system is operable to enter the deceleration mode and decrease the vessel speed by the predetermined speed from the indicated vessel speed when the deceleration switch is turned on, and return the vessel speed to the indicated vessel speed before the deceleration mode is entered when an operation is performed to cancel the deceleration mode.

In a marine vessel according to an example embodiment of the present invention, the marine propulsion system includes the deceleration switch to receive an operation to enter the deceleration mode in which the vessel speed is decreased by the predetermined speed, and is operable to enter the deceleration mode and decrease the vessel speed by the predetermined speed when the deceleration switch is turned on. Accordingly, the deceleration switch is easily operated such that the deceleration mode is entered and the vessel speed is decreased by the predetermined speed. Therefore, delicate operations such as conventional lever operations are no longer required to enter the deceleration mode, and thus the marine vessel is easily decelerated to stabilize the hull when the marine vessel rides over a wave. Furthermore, the vessel speed is decreased by the predetermined speed from the indicated vessel speed indicated by the vessel speed indicator when the deceleration mode is entered, and the vessel speed returns to the indicated vessel speed before the deceleration mode was entered when the deceleration mode is canceled such that the indicated vessel speed indicated by the vessel speed indicator is maintained when the marine vessel rides over a wave.

In a marine vessel according to an example embodiment of the present invention, the deceleration switch preferably includes a single switch to alternately receive an on operation to enter the deceleration mode and an off operation to cancel the deceleration mode. Accordingly, unlike a case in which the deceleration switch includes a plurality of switches such as a case in which the deceleration switch includes a switch for deceleration and a switch for cancellation of deceleration, the number of components is reduced, and the complexity of the device structure is reduced or prevented. Furthermore, a vessel user does not need to move his/her fingers to operate a plurality of switches when performing an operation to enter the deceleration mode and an operation to cancel the deceleration mode, and thus the deceleration switch is easily operated. Therefore, the marine vessel is more easily decelerated to stabilize the hull when the marine vessel rides over a wave.

In such a case, the deceleration switch preferably includes a deceleration mode lamp that is on during the deceleration mode and is off when the deceleration mode is canceled. Accordingly, the vessel user easily visually understands whether or not the marine vessel is in the deceleration mode.

In a marine vessel according to an example embodiment of the present invention, the deceleration switch is preferably to be turned on before the hull rides over a wave. Accordingly, the marine vessel is decelerated in advance before the hull rides over a wave, and thus the possibility that the hull jumps from the wave, for example, when the hull rides over the wave is reduced or prevented.

In a marine vessel according to an example embodiment of the present invention, the propulsion device operator preferably further includes a speed control switch to receive an operation to enter a speed control mode in which the vessel speed is finely adjusted, and an operation to finely adjust the vessel speed in the speed control mode, and a fluctuation range corresponding to the predetermined speed by which the vessel speed is decreased from the indicated vessel speed when the deceleration switch is turned on and the deceleration mode is entered is preferably larger than an adjustment range of the vessel speed in the speed control mode in which the speed control switch is operated. Accordingly, as compared with adjusting the vessel speed in the speed control mode, the vessel speed is changed relatively largely when the marine vessel rides over a wave, and the hull is effectively stabilized.

In a marine vessel according to an example embodiment of the present invention, the marine propulsion system is preferably operable to decrease the vessel speed by the predetermined speed from the indicated vessel speed concurrently with entering the deceleration mode when the deceleration switch is turned on. Accordingly, the deceleration switch is operated only once such that the deceleration mode is entered, and the vessel speed is decreased by the predetermined speed from the indicated vessel speed. Therefore, the marine vessel is quickly decelerated to stabilize the hull when the marine vessel rides over a wave.

In a marine vessel according to an example embodiment of the present invention, the vessel speed indicator preferably includes a remote control lever including a lever to adjust the indicated vessel speed when a position of the lever is changed, and the deceleration switch is preferably provided on the remote control lever. Accordingly, the deceleration switch is provided on the remote control lever that is held by the vessel user when the vessel user maneuvers the marine vessel, and thus the deceleration switch is easily operated by the hand operating the remote control lever.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

Figure 1:
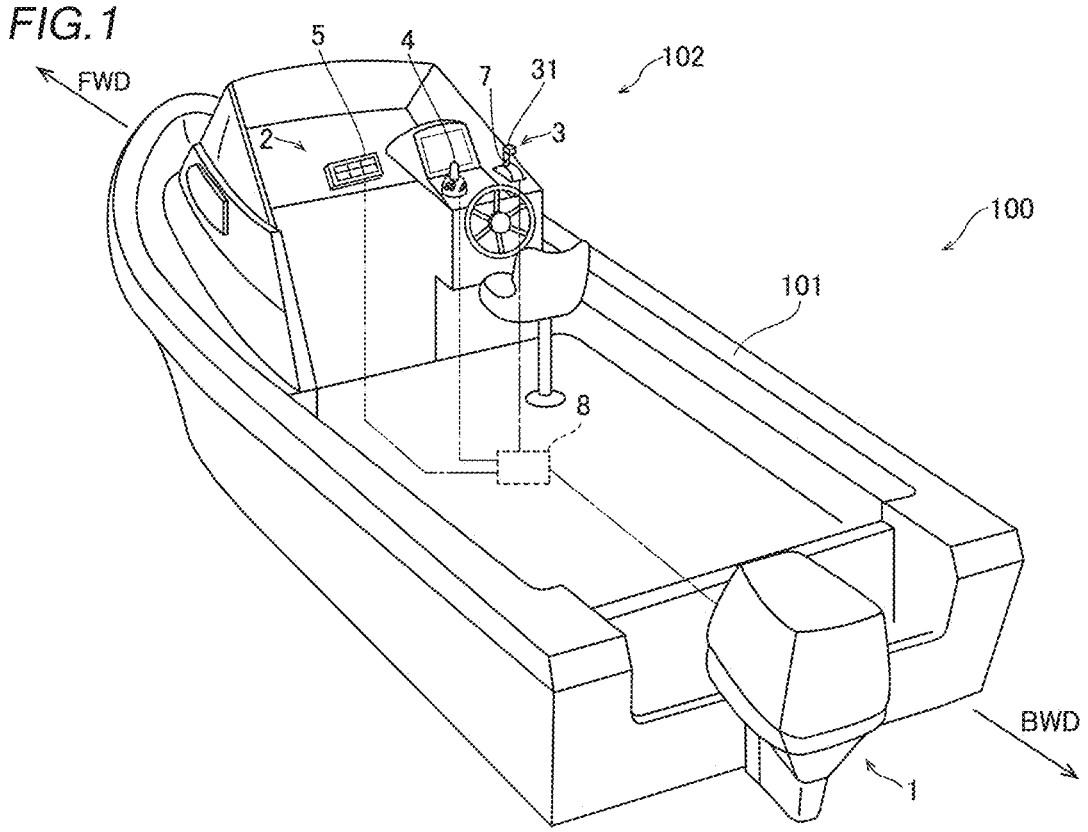
FIG. 1 is a perspective view showing a marine vessel including a marine propulsion system according to an example embodiment of the present invention.

The structure of a marine vessel 100 including a marine propulsion system 102 according to example embodiments of the present invention is now described with reference to FIGS. 1 to 6. In FIG. 1, arrow FWD represents the forward movement direction of the marine vessel 100 (front side with reference to a hull 101), and arrow BWD represents the reverse movement direction of the marine vessel 100 (rear side with reference to the hull 101).

As shown in FIG. 1, the marine vessel 100 includes the hull 101 and the marine propulsion system 102 including a propulsion device 1. The marine propulsion system 102 is provided on or in the hull 101.

The propulsion device 1 is attached to a transom of the hull 101. The propulsion device 1 includes an outboard motor. That is the marine vessel 100 is an outboard motor boat including an outboard motor as the propulsion device 1.

Figure 2:
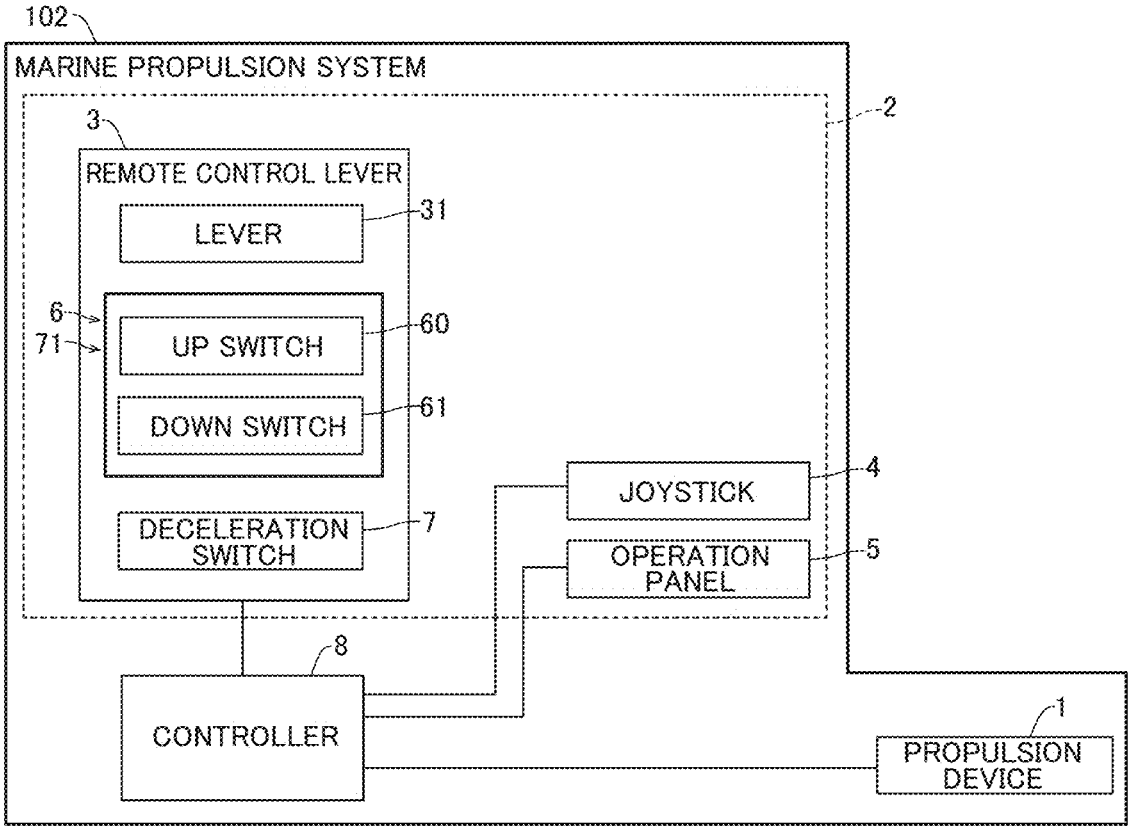
FIG. 2 is a block diagram of a marine propulsion system according to an example embodiment of the present invention.

As shown in FIG. 2, the marine propulsion system 102 includes the propulsion device 1 and a propulsion device operator 2. The propulsion device operator 2 includes a remote control lever 3 including a lever 31, a joystick 4, and an operation panel 5. The remote control lever 3 is an example of a "vessel speed indicator".

The marine propulsion system 102 also includes a speed control switch 6 on the remote control lever 3, a deceleration switch 7 on the remote control lever 3, and a controller 8.

The controller 8 of the marine propulsion system 102 stabilizes the attitude of the hull 101 by temporarily decreasing the vessel speed (or the engine speed or the throttle opening degree) of the marine vessel 100 in response to an operation on the deceleration switch 7 when the marine vessel 100 navigates over waves. In principle, the deceleration switch 7 is manually turned on and off each time in which a wave approaches the hull 101. Details are described below.

Figure 3:
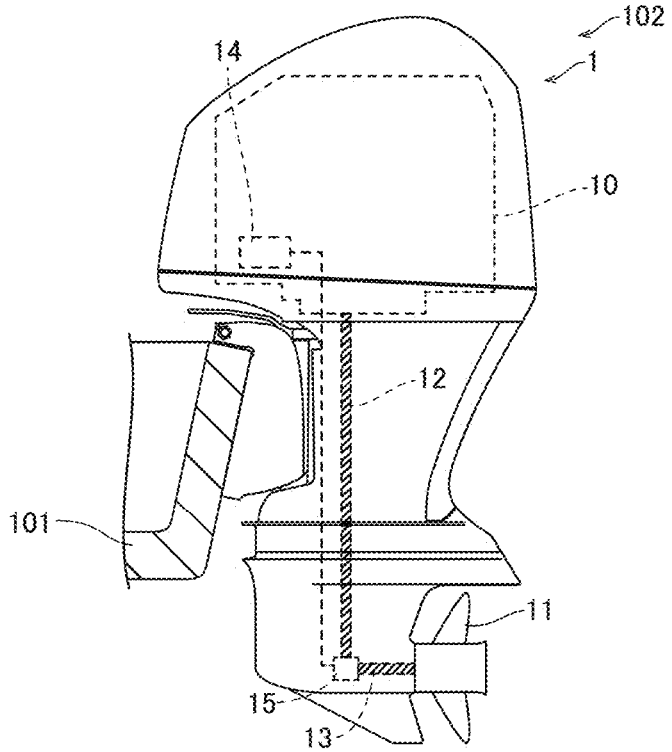
FIG. 3 is a side view showing a propulsion device of a marine propulsion system according to an example embodiment of the present invention.

As shown in FIG. 3, the propulsion device 1 includes an engine 10, a propeller 11, a drive shaft 12, a propeller shaft 13, and a shift actuator 14.

The engine 10 may be an internal combustion engine, and generates a driving force by burning fuel and rotating a crankshaft (not shown). The engine 10 includes a crank angle sensor (not shown) that measures the engine speed. The propeller 11 is rotationally driven by the driving force generated by the engine 10. The drive shaft 12 and the propeller shaft 13 transmit the driving force generated in the engine 10 to the propeller 11.

The shift actuator 14 drives a gear unit 15 provided between the drive shaft 12 and the propeller shaft 13 to switch the shift state of the propulsion device 1 to any one of a forward movement state (F state), a neutral state (N state), and a reverse movement state (R state).

Figure 4:
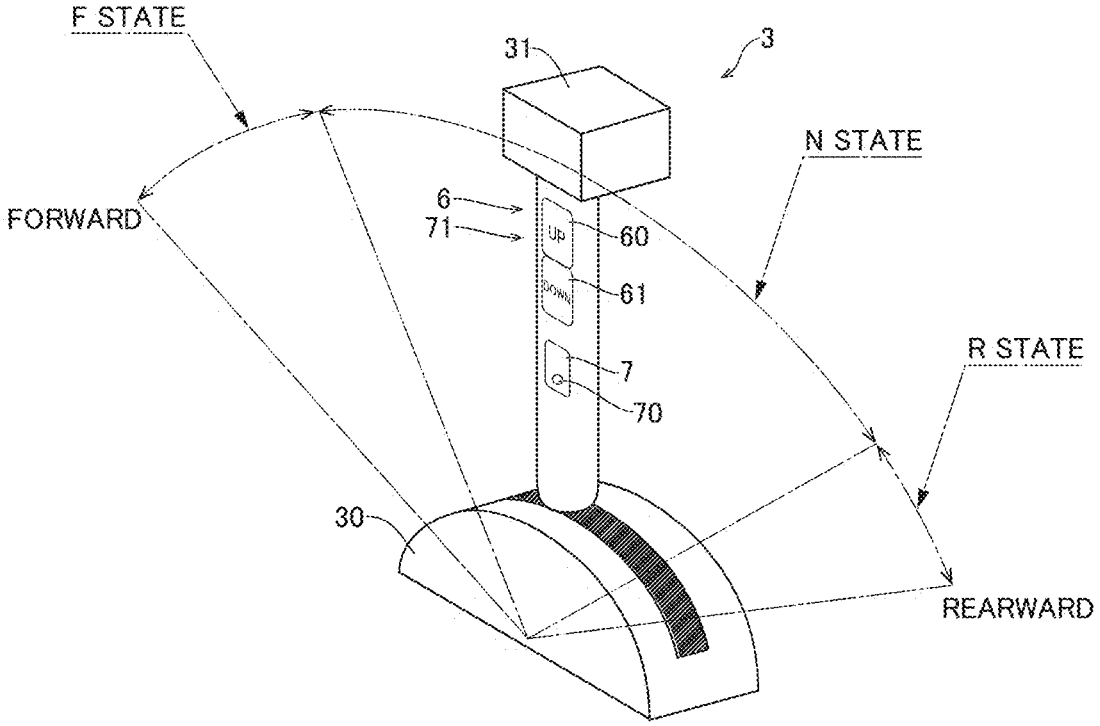
FIG. 4 is a perspective view showing a remote control lever of a marine propulsion system according to an example embodiment of the present invention.

The remote control lever 3 shown in FIG. 4 adjusts the thrust of the propulsion device 1 and switches the shift state of the propulsion device 1.

Specifically, the remote control lever 3 adjusts the thrust of the propulsion device 1 by changing an indicated vessel speed that is a vessel speed provided to the propulsion device 1. The remote control lever 3 includes a remote control main body 30 and a lever 31 provided on the remote control main body 30.

The lever 31 is able to be tilted. As an example, the lever 31 is tilted in a forward-rearward direction from a state extending upward from the remote control main body 30.

When the lever 31 extends upward, the shift state of the propulsion device 1 is in the neutral state (N state). When the lever 31 is tilted forward by a predetermined angle or more from the upwardly extending state, the shift state of the propulsion device 1 becomes the forward state (F state). When the lever 31 is tilted rearward by a predetermined angle or more from the upwardly extending state, the shift state of the propulsion device 1 becomes the reverse state (R state).

The remote control lever 3 adjusts the indicated vessel speed when the position (operation amount) of the lever 31 is changed. As an example, in the forward movement state and the reverse movement state, as the tilt angle of the lever 31 increases, the indicated vessel speed increases, and the actual vessel speed (or the engine speed or the throttle opening degree) increases. On the other hand, in the forward movement state and the reverse movement state, as the tilt angle of the lever 31 decreases, the indicated vessel speed decreases, and the actual vessel speed (or the engine speed or the throttle opening degree) decreases.

The joystick 4 shown in FIG. 1 moves the hull 101 in a tilting direction of the joystick 4 when a joystick lever is tilted. The joystick lever is tiltable not only in the forward-rearward direction but also in a right-left direction and a forward-rearward diagonal direction, unlike the lever 31 of the remote control lever 3. Furthermore, the joystick 4 adjusts the actual vessel speed (or the engine speed or the throttle opening degree) according to the tilt angle of the joystick lever.

The operation panel 5 shown in FIG. 1 includes various switches. The operation panel 5 receives operations related to various automatic marine vessel maneuvering modes, a speed control mode described below, and a deceleration mode described below, for example. The operation panel 5 is able to adjust a vessel speed parameter (a range of fluctuation in vessel speed that is decreased when the deceleration mode is entered) used in the deceleration mode. The operation panel 5 may include mechanical switches. The operation panel may be a touch panel, for example.

As shown in FIG. 4, the speed control switch 6 is provided on the lever 31 of the remote control lever 3. The speed control switch 6 is able to receive an operation to enter the speed control mode to finely adjust the vessel speed (or the engine speed or the throttle opening degree), and an operation to finely adjust the vessel speed in the speed control mode.

The speed control switch 6 includes two switches: an UP switch 60 that increases the vessel speed, and a DOWN switch 61 that decreases the vessel speed and is located below the UP switch 60.

The marine vessel 100 (see FIG. 1) enters the speed control mode when the DOWN switch 61 is pressed when the lever 31 is in the forward movement or reverse movement state. When the speed control mode is entered, the vessel speed (or the engine speed or the throttle opening degree) does not change.

The speed control mode is canceled by changing the position (operation amount) of the lever 31. That is the speed control mode is canceled by operating the lever 31 to change the indicated vessel speed indicated by the lever 31 to a different indicated vessel speed. Therefore, the indicated vessel speed is not changed by operating the lever 31 while maintaining the speed control mode. The speed control mode is not canceled simply by operating the DOWN switch 61 and the UP switch 60.

Therefore, when the speed control mode is canceled, the lever 31 is operated to change the indicated vessel speed, and thus the indicated vessel speed does not return to the indicated vessel speed indicated by the lever 31 at the time of entering the speed control mode.

When the DOWN switch 61 is pressed after the speed control mode is entered, the vessel speed is slightly decreased. As an example, when the indicated vessel speed indicated by the lever 31 when the speed control mode is entered is 3000 rpm, the vessel speed (engine speed) is decreased by 50 rpm to 2950 rpm by pressing the DOWN switch 61. Each time the DOWN switch 61 is pressed repeatedly, the vessel speed is decreased by 50 rpm.

When the UP switch 60 is pressed after the speed control mode is entered, the vessel speed is slightly increased. As an example, when the indicated vessel speed indicated by the lever 31 when the speed control mode is entered is 3000 rpm, the vessel speed (engine speed) is increased by 50 rpm to 3050 rpm. Each time the UP switch 60 is pressed repeatedly, the vessel speed is increased by 50 rpm. Naturally, the DOWN switch 61 and the UP switch 60 are alternately operable.

As shown in FIG. 4, the deceleration switch 7 is provided on the lever 31 of the remote control lever 3. The deceleration switch 7 is a mechanical button operated by being pressed. The deceleration switch 7 receives an operation to enter the deceleration mode to decrease the vessel speed by a predetermined speed (predetermined engine speed) from the indicated vessel speed indicated by the lever 31. The deceleration switch 7 includes a single switch that alternately receives an on operation to enter the deceleration mode and an off operation to cancel the deceleration mode.

The controller 8 of the marine propulsion system 102 enters the deceleration mode and decreases the vessel speed by the predetermined speed from the indicated vessel speed when the deceleration switch 7 is turned on. Furthermore, the controller 8 of the marine propulsion system 102 returns the vessel speed to the indicated vessel speed before the deceleration mode was entered when an operation is performed to cancel the deceleration mode.

Figure 5:
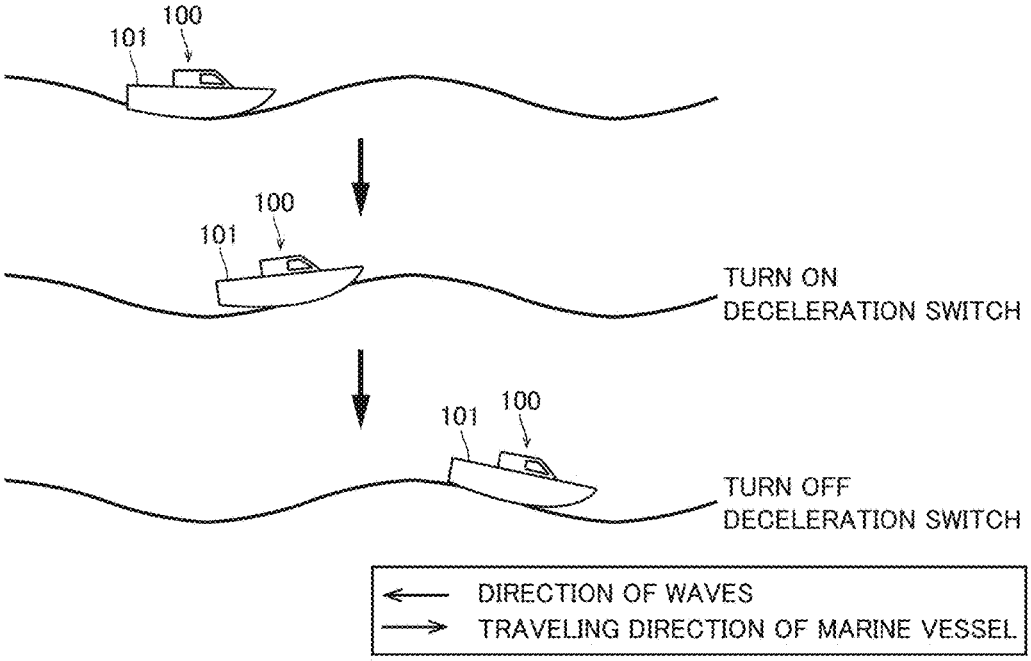
FIG. 5 is a diagram illustrating a timing of turning on and off a deceleration mode on waves.

As shown in FIG. 5, the deceleration switch 7 is turned on before the hull 101 rides over a wave. Specifically, the deceleration switch 7 is turned on before the hull 101 passes over the crest of the wave. Consequently, the marine vessel 100 is able to ride over the wave in a decelerated state, and thus the possibility that the hull 101 jumps from the wave, for example, when the marine vessel 100 rides over the wave with great force is reduced or prevented. The controller 8 of the marine propulsion system 102 lowers the bow when the marine vessel 100 rides over the wave by decreasing the vessel speed in response to the on operation to stabilize the hull 101 heading toward the crest of the wave. Although FIG. 5 shows an example in which the deceleration switch 7 is operated during a head wave, the deceleration switch 7 may be operated during a following wave.

The deceleration switch 7 is turned off after the hull 101 has ridden over the crest of the wave. Consequently, the controller 8 of the marine propulsion system 102 reduces or prevents a continuous decrease in the vessel speed when the hull 101 successively rides over a plurality of waves. In addition, the controller 8 of the marine propulsion system 102 restores the vessel speed to its original state in response to the off operation to raise the bow when the marine vessel 100 has ridden over the wave. Thus, the controller 8 of the marine propulsion system 102 stabilizes the hull 101 descending from the crest of the wave.

Entering the deceleration mode and decreasing the vessel speed by the predetermined speed from the indicated vessel speed refers to decreasing the engine speed.

Figure 6:
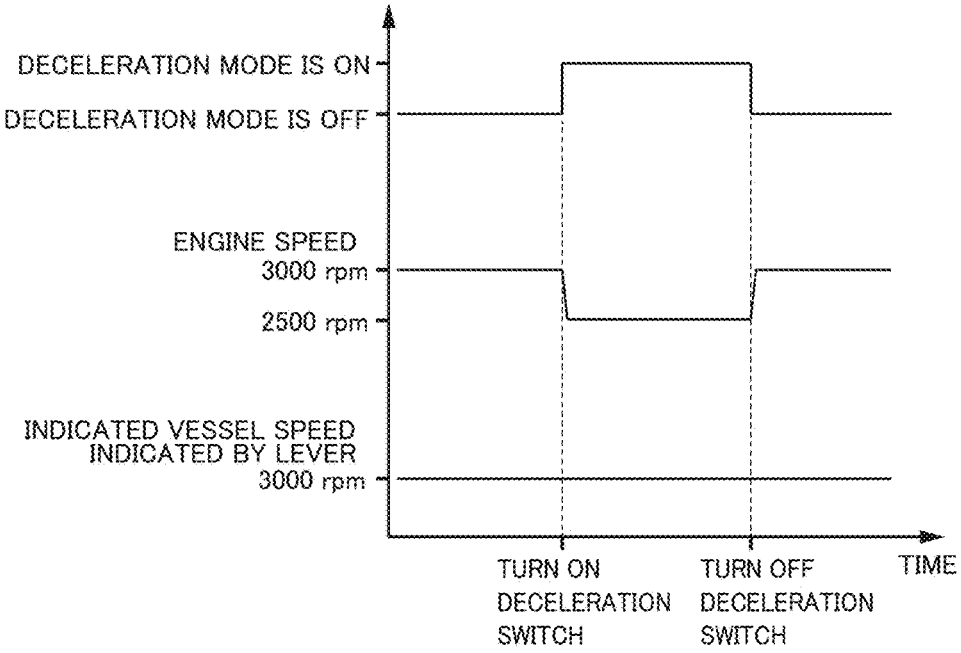
FIG. 6 is a time chart showing a relationship between time, the on state/off state of a deceleration mode, an engine speed, and an indicated vessel speed indicated by a lever.

As a specific example, as shown in FIG. 6, when the engine speed (indicated vessel speed) indicated by the lever 31 is 3000 rpm, the vessel speed is decreased from 3000 rpm by a predetermined speed of 500 rpm to 2500 rpm when the deceleration switch 7 is turned on to enter the deceleration mode.

The controller 8 of the marine propulsion system 102 decreases the vessel speed by the predetermined speed from the indicated vessel speed concurrently with entering the deceleration mode when the deceleration switch 7 is turned on. That is the controller 8 of the marine propulsion system 102 both enters the deceleration mode and decreases the vessel speed by the predetermined speed from the indicated vessel speed by a single operation on the deceleration switch 7 by a vessel user.

When the deceleration switch 7 is turned off again, the vessel speed returns to 3000 rpm, which is the indicated vessel speed before the deceleration mode was entered. The "on operation" and "off operation" refer to operations to simply press the deceleration switch 7. Furthermore, the on operation of the deceleration switch 7 refers to an operation to enter the deceleration mode, and the off operation of the deceleration switch 7 refers to an operation to cancel the deceleration mode.

The deceleration mode may be canceled in the same manner as an operation to cancel the speed control mode. For example, the controller 8 of the marine propulsion system 102 may cancel the deceleration mode when the position (operation amount) of the lever 31 of the remote control lever 3 is changed.

Specifically, referring to FIG. 4, when the lever 31 is operated to increase the vessel speed, the indicated vessel speed indicated by the lever 31 when the deceleration mode was entered is changed to a different indicated vessel speed such that the deceleration mode is canceled immediately in response to an operation on the lever 31.

When the lever 31 is operated to decrease the vessel speed, the deceleration mode is canceled when the vessel speed (engine speed) indicated by the lever 31 becomes equal to or less than the vessel speed (engine speed) in the deceleration mode. As a specific example, when the engine speed is 2500 rpm in the deceleration mode and the indicated vessel speed indicated by the lever 31 is 3000 rpm, when the lever 31 is operated to decrease the indicated vessel speed to 2500 rpm or less the deceleration mode is canceled.

A fluctuation range corresponding to the predetermined speed (predetermined engine speed) by which the vessel speed is decreased from the indicated vessel speed indicated by the lever 31 when the deceleration switch 7 is turned on and the deceleration mode is entered is larger than an adjustment range of the vessel speed in the speed control mode in which the speed control switch 6 is operated.

For example, in the example described above, the fluctuation range of the vessel speed (engine speed) corresponding to the predetermined speed when the deceleration mode is entered is 500 rpm, and the adjustment range of the vessel speed in the speed control mode in which the speed control switch 6 is operated is 50 rpm.

The deceleration switch 7 including a single switch includes a deceleration mode lamp 70 that is on during the deceleration mode and is off while the deceleration mode is canceled. The vessel user visually understands that the marine vessel 100 is in the deceleration mode by the lighted deceleration mode lamp 70. The lighting described above refers to lighting in which light is continuously emitted from the deceleration mode lamp 70. The lighting may be lighting (blinking) in which light is intermittently emitted from the deceleration mode lamp 70. The vessel user visually understands that the deceleration mode has been canceled when the deceleration mode lamp 70 is turned off.

The remote control lever 3 includes a fine adjustment switch 71 to receive an operation to finely adjust the vessel speed by increasing or decreasing the vessel speed by a fluctuation range smaller than the fluctuation range corresponding to the predetermined speed (predetermined engine speed) by which the vessel speed is decreased from the indicated vessel speed in the deceleration mode.

The fine adjustment switch 71 is also used as the speed control switch 6. Therefore, the fine adjustment switch 71 includes two switches: the UP switch 60 and the DOWN switch 61 located below the UP switch 60 to decrease the vessel speed.

The deceleration switch 7 and the fine adjustment switch 71 are located side by side on the lever 31. The deceleration switch 7 and the fine adjustment switch 71 may be located on the left side of the lever 31. The deceleration switch 7 may be located below the fine adjustment switch 71.

The controller 8 of the marine propulsion system 102 finely adjusts the vessel speed by increasing or decreasing the vessel speed in response to an operation on the fine adjustment switch 71 in the deceleration mode without entering the speed control mode. The fine adjustment of the vessel speed in the deceleration mode by the fine adjustment switch 71 is performed by the same operation as the fine adjustment of the vessel speed in the speed control mode.

As a specific example, when the engine speed (indicated vessel speed) indicated by the lever 31 is 3000 rpm, the vessel speed is decreased from 3000 rpm by 500 rpm, which is the predetermined speed (predetermined engine speed), to 2500 rpm when the deceleration switch 7 is turned on and the deceleration mode is entered.

When the DOWN switch 61 of the deceleration switch 7 is pressed while the engine speed is 2500 rpm, the vessel speed (engine speed) is decreased by 50 rpm to 2450 rpm. Furthermore, each time the DOWN switch 61 is repeatedly pressed, the vessel speed is decreased by 50 rpm. Although an example is described above in which the (fine) adjustment range of the vessel speed in the deceleration mode and the (fine) adjustment range of the vessel speed in the speed control mode are both 50 rpm, the (fine) adjustment range of the vessel speed in the deceleration mode and the (fine) adjustment range of the vessel speed in the speed control mode may be different from each other. That is, the adjustment range of the vessel speed in the deceleration mode may be larger or smaller than the adjustment range of the vessel speed in the speed control mode.

When the UP switch 60 of the deceleration switch 7 is pressed while the engine speed is 2500 rpm, the vessel speed (engine speed) is increased by 50 rpm to 2550 rpm. Furthermore, each time the UP switch 60 is repeatedly pressed, the vessel speed is increased by 50 rpm. Naturally, the DOWN switch 61 and the UP switch 60 are alternately operable.

The marine propulsion system 102 is able to vary the fluctuation range (500 rpm described above) corresponding to the predetermined speed (predetermined engine speed) by which the vessel speed is decreased from the indicated vessel speed when the deceleration switch 7 is turned on and the deceleration mode is entered. The operation panel 5 receives an operation to vary the fluctuation range. As an example, when a predetermined switch on the operation panel 5 is pressed, an adjustment mode is entered in which an adjustment is made to increase or decrease the predetermined speed (engine speed) by which the vessel speed is decreased from the indicated vessel speed when the deceleration mode was entered. In the adjustment mode, 500 rpm described above may be varied to 450 rpm, 550 rpm, or 600 rpm, for example.

The controller 8 is provided in the hull 101. The controller 8 acquires operation signals of the deceleration switch 7 and the fine adjustment switch 71. The controller 8 acquires operation signals from the remote control lever 3, the operation panel 5, and the joystick 4, and controls various drives of the propulsion device 1 based on the operations on the deceleration switch 7 described above. The controller 8 includes a CPU and a memory. The controller 8 includes a remote control ECU that is connected to the propulsion device 1 and transmits a signal to control the drive of the propulsion device 1. The controller may include a BCU (boat control unit), for example, which controls automatic marine vessel maneuvering, etc., instead of the remote control ECU. The BCU is provided in or on the hull.

According to the various example embodiments of the present invention described above, the following advantageous effects are achieved.

According to an example embodiment of the present invention, the marine propulsion system 102 includes the deceleration switch 7 to enter the deceleration mode and decrease the vessel speed by the predetermined speed when the deceleration switch 7 is turned on, and return the vessel speed to the vessel speed before the deceleration mode was entered when an operation is performed to cancel the deceleration mode. Accordingly, the deceleration switch 7 is easily operated such that the deceleration mode is entered and the vessel speed is decreased by the predetermined speed. Furthermore, an operation is performed to cancel the deceleration mode such that the vessel speed returns to the vessel speed before the deceleration mode was entered. Therefore, delicate operations such as conventional lever operations are no longer required, and thus the marine vessel 100 is easily decelerated to stabilize the hull 101 when the marine vessel 100 rides over a wave. Furthermore, the vessel speed is decreased by the predetermined speed from the indicated vessel speed indicated by the remote control lever 3 (vessel speed indicator) when the deceleration mode was entered, and the vessel speed returns to the indicated vessel speed before the deceleration mode was entered when the deceleration mode is canceled such that the indicated vessel speed indicated by the remote control lever 3 is maintained when the marine vessel 100 rides over a wave.

According to an example embodiment of the present invention, the deceleration switch 7 includes a single switch to alternately receive an on operation to enter the deceleration mode and an off operation to cancel the deceleration mode. Accordingly, unlike a case in which the deceleration switch 7 includes a plurality of switches such as a case in which the deceleration switch 7 includes a switch for deceleration and a switch for cancellation of the deceleration, the number of components is reduced, and the complexity of the device structure is reduced or prevented. Furthermore, the vessel user does not need to move his/her fingers to operate a plurality of switches when performing an operation to enter the deceleration mode and an operation to cancel the deceleration mode, and thus the deceleration switch 7 is easily operated. Therefore, the marine vessel 100 is more easily decelerated to stabilize the hull 101 when the marine vessel 100 rides over a wave.

According to an example embodiment of the present invention, the deceleration switch 7 includes the deceleration mode lamp 70 that is on during the deceleration mode and is off when the deceleration mode is canceled. Accordingly, the vessel user easily visually understands that the marine vessel 100 is in the deceleration mode.

According to an example embodiment of the present invention, the deceleration switch 7 is turned on before the hull 101 rides over a wave. Accordingly, the marine vessel 100 is decelerated in advance before the hull 101 rides over a wave, and thus the possibility that the hull 101 jumps from the wave, for example, when the hull 101 rides over the wave is reduced or prevented.

According to an example embodiment of the present invention, the marine propulsion system 102 further includes the speed control switch 6 in the propulsion device operator 2 to receive an operation to enter the speed control mode in which the vessel speed is finely adjusted, and an operation to finely adjust the vessel speed in the speed control mode, and the fluctuation range corresponding to the predetermined speed by which the vessel speed is decreased from the indicated vessel speed when the deceleration switch 7 is turned on and the deceleration mode is entered is larger than the adjustment range of the vessel speed in the speed control mode in which the speed control switch 6 is operated. Accordingly, as compared with adjusting the vessel speed in the speed control mode, the vessel speed is changed relatively largely when the marine vessel 100 rides over a wave, and the hull 101 is effectively stabilized.

According to an example embodiment of the present invention, the marine propulsion system 102 is operable to decrease the vessel speed by the predetermined speed from the indicated vessel speed concurrently with entering the deceleration mode when the deceleration switch 7 is turned on. Accordingly, the deceleration switch 7 is operated only once such that the deceleration mode is entered, and the vessel speed is decreased by the predetermined speed from the indicated vessel speed. Therefore, the marine vessel 100 is quickly decelerated to stabilize the hull 101 when the marine vessel 100 rides over a wave.

According to an example embodiment of the present invention, the vessel speed indicator includes the remote control lever 3 including the lever 31 to adjust the indicated vessel speed when the position (operation amount) of the lever 31 is changed, and the deceleration switch 7 is provided on the remote control lever 3. Accordingly, the deceleration switch 7 is provided on the remote control lever 3 that is held by the vessel user when the vessel user maneuvers the marine vessel 100, and thus the deceleration switch 7 is easily operated by the hand operating the remote control lever 3.

According to an example embodiment of the present invention, the remote control lever 3 includes the fine adjustment switch 71 to receive an operation to finely adjust the vessel speed by increasing or decreasing the vessel speed by the fluctuation range smaller than the fluctuation range corresponding to the predetermined speed by which the vessel speed is decreased from the indicated vessel speed when the deceleration mode is entered. Accordingly, with the marine vessel 100 is decelerated in the deceleration mode, the fine adjustment switch 71 is used to finely adjust the vessel speed such that the hull 101 is further stabilized.

According to an example embodiment of the present invention, the deceleration switch 7 and the fine adjustment switch 71 are located side by side on the lever 31. Accordingly, as compared with a case in which the deceleration switch and the fine adjustment switch are spaced far apart from each other, the deceleration switch 7 and the fine adjustment switch 71 are easily operated.

According to an example embodiment of the present invention, the marine propulsion system 102 further includes the speed control switch 6 in the propulsion device operator 2 to receive an operation to enter the speed control mode in which the vessel speed is finely adjusted, and an operation to finely adjust the vessel speed in the speed control mode. The fine adjustment switch 71 is also used as the speed control switch 6, and the marine propulsion system 102 is operable to finely adjust the vessel speed by increasing or decreasing the vessel speed in response to an operation on the fine adjustment switch 71 in the deceleration mode without entering the speed control mode. Accordingly, as compared with a case in which the fine adjustment switch and the speed control switch are separate, the number of switches in the propulsion device operator 2 is reduced, and the device structure is simplified.

According to an example embodiment of the present invention, the deceleration mode is also canceled by changing the position (operation amount) of the lever 31 of the remote control lever 3. Accordingly, the deceleration mode is canceled by various methods, and thus the operability of the marine propulsion system 102 is improved.

According to an example embodiment of the present invention, the fluctuation range corresponding to the predetermined speed by which the vessel speed is decreased from the indicated vessel speed when the deceleration switch 7 is turned on and the deceleration mode is entered is variable, and the propulsion device operator 2 is operable to receive an operation to vary the fluctuation range. Accordingly, the magnitude of the predetermined speed by which the vessel speed is decreased from the indicated vessel speed when the deceleration switch 7 is turned on and the deceleration mode is entered is adjusted taking into consideration wave conditions such as a wave size and a wave speed.

According to an example embodiment of the present invention, the deceleration switch 7 is a mechanical button operated by being pressed. Accordingly, the deceleration switch 7, which is a mechanical button (physical button) operated by being pressed, is operated such that the marine vessel 100 is easily decelerated to stabilize the hull 101 when the marine vessel 100 rides over a wave.

The example embodiments of the present invention described above are illustrative in all points and not restrictive. The extent of the present invention is not defined by the above description of the example embodiments but by the scope of the claims, and all modifications within the meaning and range equivalent to the scope of the claims are further included.

For example, while the propulsion device preferably includes an outboard motor in example embodiments described above, the present invention is not restricted to this. In an example embodiment of the present invention, the propulsion device may alternatively include an inboard motor or an inboard-outboard motor, for example.

While the deceleration switch preferably includes a single switch in example embodiments described above, the present invention is not restricted to this. In an example embodiment of the present invention, the deceleration switch may alternatively include a plurality of switches. For example, the deceleration switch may include two switches: a switch to decelerate to enter the deceleration mode and decelerate the marine vessel, and a switch to cancel the deceleration to cancel the deceleration mode.

While the vessel speed indicator preferably includes a remote control lever in example embodiments described above, the present invention is not restricted to this. In an example embodiment of the present invention, the vessel speed indicator may alternatively include a joystick or an operation panel, for example.

While one propulsion device is preferably attached to the hull in example embodiments described above, the present invention is not restricted to this. In an example embodiment of the present invention, more than one propulsion device may alternatively be attached to the hull.

While the predetermined speed (engine speed) by which the vessel speed is decreased when the deceleration switch is turned on is preferably 500 rpm in example embodiments described above, the present invention is not restricted to this. In an example embodiment of the present invention, the predetermined speed (engine speed) by which the vessel speed is decreased when the deceleration switch is turned on may alternatively be different from 500 rpm.

While the predetermined speed by which the vessel speed is decreased when the deceleration switch is turned on is preferably set based on the engine speed in example embodiments described above, the present invention is not restricted to this. In an example embodiment of the present invention, the predetermined speed by which the vessel speed is decreased when the deceleration switch is turned on may alternatively be set based on a vessel speed itself obtained from a GPS or the like, or a throttle opening degree, for example.

While the fine adjustment switch is preferably also used as a speed control switch in example embodiments described above, the present invention is not restricted to this. In an example embodiment of the present invention, the fine adjustment switch and the speed control switch may alternatively be separate.

Furthermore, the timing of operating the deceleration switch may be freely determined by the vessel user in response to upcoming waves, and is not restricted to the timing described in example embodiments described above.

While the marine vessel preferably includes the speed control switch in example embodiments described above, the present invention is not restricted to this. In an example embodiment of the present invention, the marine vessel may not include the speed control switch.

While the deceleration switch is preferably provided on the lever of the remote control lever in example embodiments described above, the present invention is not restricted to this. In an example embodiment of the present invention, the deceleration switch may alternatively be provided on the remote control main body of the remote control lever the joystick, or the operation panel, for example.

While the deceleration switch is preferably a mechanical button operated by being pressed in example embodiments described above, the present invention is not restricted to this. In an example embodiment of the present invention, the deceleration switch may alternatively be a switch provided on a touch panel, for example.

While the controller preferably acquires operation signals of the deceleration switch and the fine adjustment switch in example embodiments described above, the present invention is not restricted to this. In an example embodiment of the present invention, the propulsion device may alternatively directly acquire operation signals of the deceleration switch and the fine adjustment switch. In such a case, when the deceleration switch is turned on, the propulsion device (such as an ECU of the propulsion device) performs a control to enter the deceleration mode and decrease the vessel speed by the predetermined speed from the indicated vessel speed, for example.

While the propulsion device is preferably engine-driven in example embodiments described above, the present invention is not restricted to this. In an example embodiment of the present invention, the propulsion device may alternatively be driven by an electric motor. In such a case, when the deceleration switch is turned on, the drive rate (rotation speed) of the electric motor decreases.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a propulsion device to be provided on a hull;

a propulsion device operator including:

a vessel speed indicator to adjust a thrust of the propulsion device by changing an indicated vessel speed that is a vessel speed provided to the propulsion device; and a deceleration switch to receive an operation to enter a deceleration mode in which the vessel speed is decreased by a predetermined speed from the indicated vessel speed; wherein the marine propulsion system is operable to enter the deceleration mode and decrease the vessel speed by the predetermined speed from the indicated vessel speed when the deceleration switch is turned on, and return the vessel speed to the indicated vessel speed before the deceleration mode is entered when an operation is performed to cancel the deceleration mode;

the propulsion device operator further includes a speed control switch to receive an operation to enter a speed control mode in which the vessel speed is able to be finely adjusted, and an operation to finely adjust the vessel speed in the speed control mode; and a fluctuation range corresponding to the predetermined speed by which the vessel speed is decreased from the indicated vessel speed when the deceleration switch is turned on and the deceleration mode is entered is larger than an adjustment range of the vessel speed in the speed control mode in which the speed control switch is operated.

2. The marine propulsion system according to claim 1, wherein the deceleration switch includes a single switch to alternately receive an on operation to enter the deceleration mode and an off operation to cancel the deceleration mode.

3. The marine propulsion system according to claim 2, wherein the deceleration switch includes a deceleration mode lamp that is on during the deceleration mode and is off when the deceleration mode is canceled.

4. The marine propulsion system according to claim 1, wherein the deceleration switch is to be turned on before the hull rides over a wave.

5. The marine propulsion system according to claim 1, wherein the marine propulsion system is operable to decrease the vessel speed by the predetermined speed from the indicated vessel speed concurrently with entering the deceleration mode when the deceleration switch is turned on.

6. The marine propulsion system according to claim 1, wherein the vessel speed indicator includes a remote control lever including a lever to adjust the indicated vessel speed when a position of the lever is changed; and the deceleration switch is provided on the remote control lever.

7. The marine propulsion system according to claim 6, wherein the deceleration mode is able to be canceled by changing the position of the lever of the remote control lever.

8. The marine propulsion system according to claim 7, wherein the remote control lever includes a fine adjustment switch to receive an operation to finely adjust the vessel speed in the deceleration mode by increasing or decreasing the vessel speed; and the fine adjustment switch is also used as the speed control switch.

9. The marine propulsion system according to claim 8, wherein the deceleration switch and the fine adjustment switch are side by side on the lever.

10. The marine propulsion system according to claim 8, wherein the marine propulsion system is operable to finely adjust the vessel speed by increasing or decreasing the vessel speed in response to an operation on the fine adjustment switch in the deceleration mode without entering the speed control mode.

11. The marine propulsion system according to claim 1, wherein a fluctuation range corresponding to the predetermined speed by which the vessel speed is decreased from the indicated vessel speed when the deceleration switch is turned on and the deceleration mode is entered is variable; and the propulsion device operator is operable to receive an operation to vary the fluctuation range.

12. The marine propulsion system according to claim 1, wherein the deceleration switch is a mechanical button operable by being pressed.

13. A marine vessel comprising:

a hull; and a marine propulsion system provided on or in the hull; wherein the marine propulsion system includes:

a propulsion device;

a propulsion device operator including:

a vessel speed indicator to adjust a thrust of the propulsion device by changing an indicated vessel speed that is a vessel speed provided to the propulsion device; and a deceleration switch to receive an operation to enter a deceleration mode in which the vessel speed is decreased by a predetermined speed from the indicated vessel speed; and the marine propulsion system is operable to enter the deceleration mode and decrease the vessel speed by the predetermined speed from the indicated vessel speed when the deceleration switch is turned on, and return the vessel speed to the indicated vessel speed before the deceleration mode is entered when an operation is performed to cancel the deceleration mode;

the propulsion device operator further includes a speed control switch to receive an operation to enter a speed control mode in which the vessel speed is finely adjusted, and an operation to finely adjust the vessel speed in the speed control mode; and a fluctuation range corresponding to the predetermined speed by which the vessel speed is decreased from the indicated vessel speed when the deceleration switch is turned on and the deceleration mode is entered is larger than an adjustment range of the vessel speed in the speed control mode in which the speed control switch is operated.

14. The marine vessel according to claim 13, wherein the deceleration switch includes a single switch to alternately receive an on operation to enter the deceleration mode and an off operation to cancel the deceleration mode.

15. The marine vessel according to claim 14, wherein the deceleration switch includes a deceleration mode lamp that is on during the deceleration mode and is off when the deceleration mode is canceled.

16. The marine vessel according to claim 13, wherein the deceleration switch is to be turned on before the hull rides over a wave.

17. The marine vessel according to claim 13, wherein the marine propulsion system is operable to decrease the vessel speed by the predetermined speed from the indicated vessel speed concurrently with entering the deceleration mode when the deceleration switch is turned on.

18. The marine vessel according to claim 13, wherein the vessel speed indicator includes a remote control lever including a lever to adjust the indicated vessel speed when a position of the lever is changed; and the deceleration switch is provided on the remote control lever.

19. A marine propulsion system comprising:

a propulsion device to be provided on a hull;

a propulsion device operator including:

a vessel speed indicator to adjust a thrust of the propulsion device by changing an indicated vessel speed that is a vessel speed provided to the propulsion device; and a deceleration switch to receive an operation to enter a deceleration mode in which the vessel speed is decreased by a predetermined speed from the indicated vessel speed; wherein the marine propulsion system is operable to enter the deceleration mode and decrease the vessel speed by the predetermined speed from the indicated vessel speed when the deceleration switch is turned on, and return the vessel speed to the indicated vessel speed before the deceleration mode is entered when an operation is performed to cancel the deceleration mode; and the propulsion device operator is operable to receive an operation to vary a fluctuation range corresponding to the predetermined speed by which the vessel speed is decreased from the indicated vessel speed when the deceleration switch is turned on.

* * * * *